US010471315B2

(12) United States Patent
Jessup et al.

(10) Patent No.: US 10,471,315 B2
(45) Date of Patent: Nov. 12, 2019

(54) GOLF BALL MARKER

(71) Applicants: Philip Jessup, Ennismore (CA); Eleanor Jessup, Ennismore (CA)

(72) Inventors: Philip Jessup, Ennismore (CA); Eleanor Jessup, Ennismore (CA)

( * ) Notice: Subject to any disclaimer, the term of this patent is extended or adjusted under 35 U.S.C. 154(b) by 96 days.

(21) Appl. No.: 15/618,610

(22) Filed: Jun. 9, 2017

(65) Prior Publication Data

US 2017/0361182 A1 Dec. 21, 2017

Related U.S. Application Data

(60) Provisional application No. 62/351,524, filed on Jun. 17, 2016.

(51) Int. Cl.

| | |
|---|---|
| ***A63B 57/00*** | (2015.01) |
| ***A63B 47/00*** | (2006.01) |
| ***B43K 23/016*** | (2006.01) |
| ***A63B 43/00*** | (2006.01) |

(52) U.S. Cl.

CPC ..... *A63B 57/00* (2013.01); *A63B 47/00* (2013.01); *B43K 23/016* (2013.01); *A63B 43/008* (2013.01); *A63B 2225/08* (2013.01)

(58) Field of Classification Search

CPC ..... A63B 45/02; A63B 57/00; A63B 57/30; B43K 23/016

USPC ..... 401/62, 81

See application file for complete search history.

(56) References Cited

U.S. PATENT DOCUMENTS

| | | | | |
|---|---|---|---|---|
| 2,453,867 | A * | 11/1948 | Shatkin | A45D 40/10 401/62 |
| 3,019,762 | A | 2/1962 | Hautz | |
| 5,120,358 | A | 6/1992 | Pippett | |
| 5,620,376 | A | 4/1997 | Hsu | |
| 6,692,373 | B2 | 2/2004 | Hultquist | |
| 7,399,234 | B2 | 7/2008 | Geraty | |
| 9,717,971 | B1 | 8/2017 | Moore | |
| 9,764,214 | B1 | 9/2017 | Martin | |
| 2012/0115625 | A1 | 5/2012 | Comi | |
| 2017/0361182 | A1 | 12/2017 | Jessup et al. | |

FOREIGN PATENT DOCUMENTS

| | | | | |
|---|---|---|---|---|
| DE | 102003047999 | A1 * | 4/2008 | A63B 45/02 |
| DE | 102006047999 | A1 * | 4/2008 | A63B 45/02 |

* cited by examiner

*Primary Examiner* — David P Angwin
*Assistant Examiner* — Bradley S Oliver
(74) *Attorney, Agent, or Firm* — Dinsmore & Shohl LLP

(57) ABSTRACT

A golf ball marker for applying chalk to a golf ball. The golf ball marker includes a housing having two space ends and in which one end is dimensioned to support a golf ball. A plunger is slidably mounted in the housing while chalk is carried at the end of the plunger. Consequently, upon movement of the plunger towards the golf ball, the chalk contacts and marks the golf ball.

6 Claims, 2 Drawing Sheets

GOLF BALL MARKER

CROSS-REFERENCE TO RELATED APPLICATIONS

This application claims priority to U.S. Provisional Patent Application No. 62/351,524, filed Jun. 17, 2016 and entitled GOLF BALL MARKER.

FIELD OF THE INVENTION

The present invention relates generally to sports equipment and, more particularly, to a device for marking a golf ball.

BACKGROUND OF THE INVENTION

In the sport of golf, the impact between the golf club head and the golf ball controls the flight, height, and distance of the golf shot. Indeed, many skilled players are able to impart spin to the ball to curve the flight path of the ball once hit.

For example, a golf swing in which the golf club head from the inside of the golf ball towards the outside as the ball is struck imparts a counterclockwise spin to the ball as viewed from the top and for a right-hand golfer. This spin will cause the golf ball to travel in an arc in which the ball is drawn or moves left to right for a right-hand golfer. Conversely, a golf club swing in which the golf club moves from the outside and towards the inside of the golf ball as the golf ball is struck will impart an opposite spin to the golf ball. This opposite spin will cause the ball to move left to right or fade in the opposite direction from a draw. Still other variations of the golf swing will produce additional lift to the golf ball, cause the golf ball to travel in a lower projectile, etc.

Previously, there have been no known ways of easily and inexpensively determining the direction of the golf club head as the golf club head impacts upon the golf ball. Instead, it has been necessary, when practicing the golf swing, to estimate the direction of travel of the golf club head at impact from the results of the golf club shot, i.e. either a draw, a fade, or a straight shot.

SUMMARY OF THE INVENTION

The present invention provides a golf ball marker which overcomes the above disadvantages of the prior art.

In brief, the present invention provides a golf ball marker in which a chalk spot is applied to the ball at the position that the ball will be struck by the golf club head. Once the ball is struck by the golf club head, the chalk from the golf ball is jarred loose by the impact of the golf club shot and the now loose chalk impacts upon the golf club head. Consequently, by examining the pattern of the chalk left on the golf club head after the golf shot, the direction of the golf club head at the time of impact may be accurately determined.

BRIEF DESCRIPTION OF THE DRAWING

A better understanding of the present invention will be had upon reference to the following detailed description when read in conjunction with the accompanying drawing, wherein like reference characters refer to like parts throughout the several views, and in which.

DETAILED DESCRIPTION OF A PREFERRED EMBODIMENT OF THE INVENTION

Figure 1:
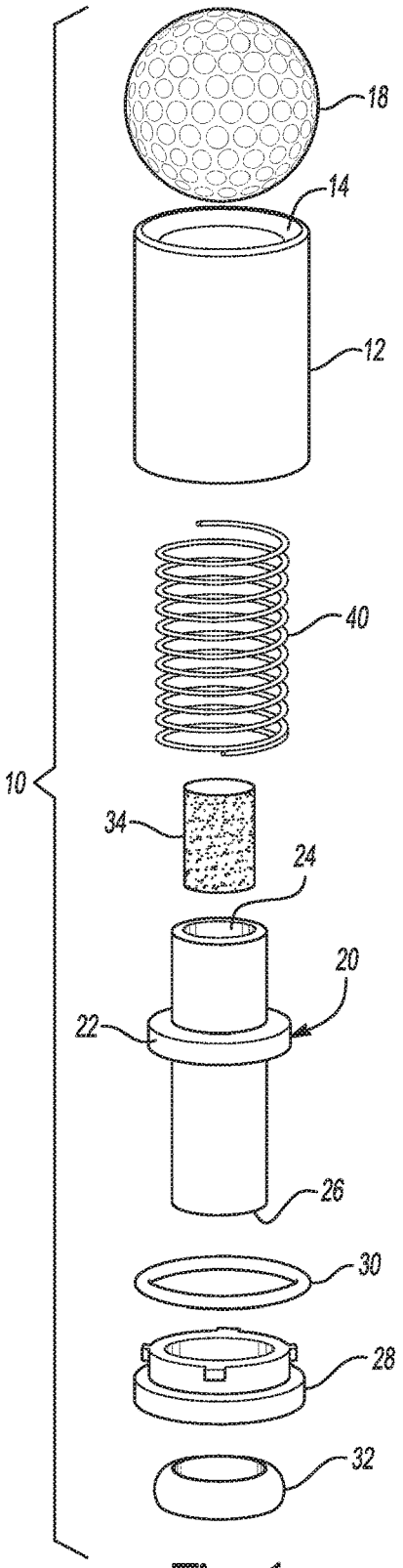
FIG. 1 is an exploded view illustrating a preferred embodiment of the golf ball marker of the present invention.
Figure 2:
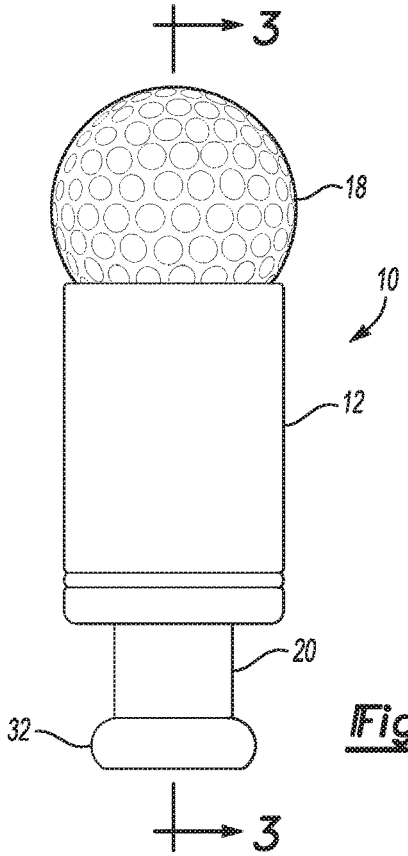
FIG. 2 is a side view of the golf ball marker of the present invention.

With reference to the drawing, a preferred embodiment of a golf ball marker 10 according to the present invention is shown. The golf ball marker 10 includes a generally tubular and cylindrical housing 12 open at both ends 14 and 16. The end 14, furthermore, is dimensioned so that it is slightly less than the diameter of a golf ball 18. As such, the open end 14 of the housing 12 is able to support a golf ball as shown in FIGS. 2 and 3.

Figure 3:
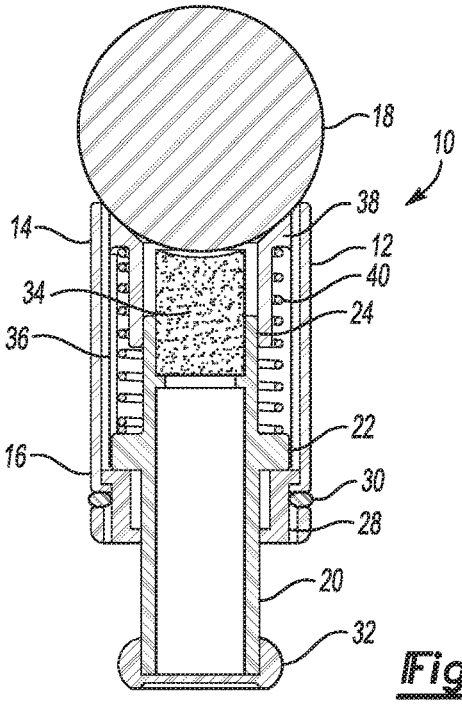
FIG. 3 is a sectional view taken along line 3-3 in FIG. 2.

An elongated plunger 20 having an enlarged diameter ring 22 at a point between its ends 24 and 26 is positioned in the housing 12 as shown in FIG. 3. In doing so, the end 24 of the plunger 20 is contained within the interior of the housing 12 while the other end 26 of the plunger 20 protrudes outwardly from the end 16 of the housing 12.

An end ring 28 is attached to the end 16 of the housing 12 so that the enlarged diameter ring 22 is contained within the housing 12. The end ring 28 is secured to the end 16 of the housing 12 in any conventional fashion, such as a threaded connection, and an O-ring 30 preferably provides a seal between the end ring 28 and the housing 12.

The end ring 28, furthermore, includes a throughbore through which the portion of the plunger 20 between the enlarged diameter ring 22 and the end 26 is slidably disposed. In addition, a cap 32 is attached to the end 26 of the plunger 20.

A cylindrical piece of chalk 34 is mounted within a recess 36 at the end 24 of the plunger 20. In doing so, as best shown in FIG. 3, the chalk 34 is contained within the interior of the housing 12 and is generally coaxial with the housing 12.

As best shown in FIG. 3, a spring retainer 38 is attached to the end 14 of the housing 12. A helical compression spring 40 is also sandwiched in a state of compression in between the spring retainer 38 and the enlarged diameter ring 22 of the plunger 20. The plunger 20, however, is axially movable within the housing 12 by depressing the cap 32 and compressing the compression spring 40.

In use, in order to mark the golf ball 18, the golf ball 18 is first placed on the open end 14 of the housing 12 as shown in FIGS. 2 and 3. Thereafter, the plunger 20 is depressed against the force of the compression spring 40 until the chalk 34 abuts against the golf ball 18. When this occurs, the golf ball 18 and/or chalk 34 are manually rotated relative to each other thus leaving a spot of chalk on the golf ball 18. The actual size of the spot of the chalk will be substantially the diameter of the chalk 34.

After the golf ball 18 is marked with chalk, the golf ball is placed on the golf mat, tee, or ground so that the chalk mark is positioned at the point of impact of the golf club head. Thereafter, the golf ball is struck and the chalk dispersion pattern onto the golf club head is examined to identify the direction of travel of the golf club head at the time of impact.

Figure 4A:
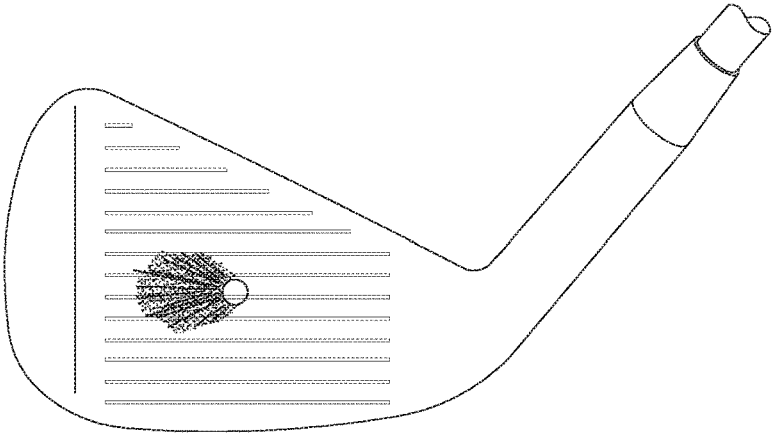
FIGS. 4A-4C are exemplary marks left on a golf club head using the present invention
Figure 4B:
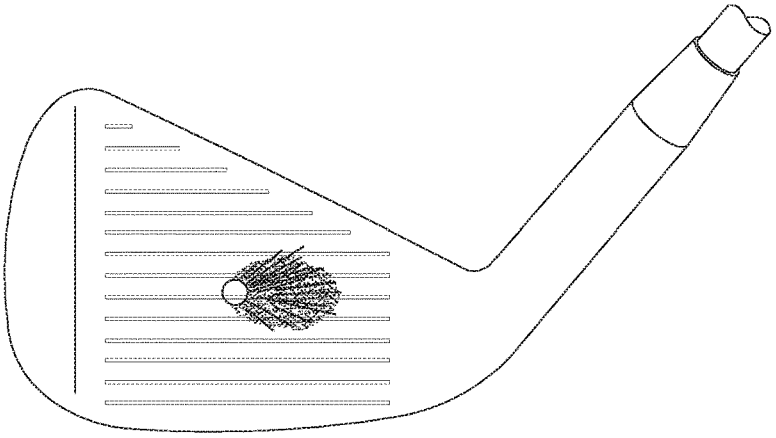
Figure 4C:
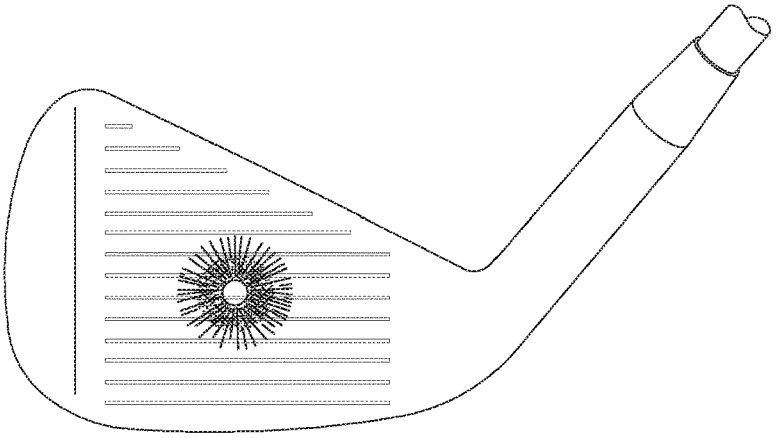

For example, and with reference to FIGS. 4A-4C, in FIG. 4A, the chalk is dispensed on the club head in a direction extending substantially horizontally outwardly on the golf club head. Such a pattern would indicate that the golf head was traveling from a position outside and inwardly at the time of impact with the golf ball. Conversely, FIG. 4B shows a chalk pattern on the golf club head extending generally laterally toward the shaft of the golf club. Such a pattern would be indicative that the golf club head was travelling from the inside and outwardly at the time of impact with the golf ball. Finally, FIG. 4C indicates an even distribution of the chalk powder around the point of impact between the golf club and the golf ball. Such a pattern would indicate that the golf ball was squarely struck during the golf stroke.

Since the plunger 20 axially displaces the chalk 34 in the housing 12, the chalk 34 may be almost completely used before discarded. Furthermore, the plunger 18 between the cap 32 and the enlarged diameter portion 22 is preferably hollow and designed to contain a spare chalk 34.

From the foregoing, it can be seen that the present invention provides a simple yet effective apparatus for marking a golf ball with chalk to determine the direction of the golf club head at the time of impact of the golf club head with the golf ball.

We claim:

1. A marker for use with a golf ball, said marker comprising:

a housing having two spaced ends, a first of said ends defining an open rim edge dimensioned to support the golf ball, a plunger slidably mounted in said housing, said plunger having an enlarged diameter ring at a point between said spaced ends of said housing;

an end ring secured to the other of said spaced ends of said housing and having a through bore through which a portion of said plunger extends, said plunger being biased in a direction within said housing so that said enlarged diameter ring seats upon said end ring;

a marking material carried at an end of said plunger so that, upon movement of said plunger toward said golf ball in response to a counter bias exerted against said extending portion of said plunger, said marking material is adapted to contact the golf ball;

the plunger bias further including a coil spring contained in said housing, one end of said spring biasing against said enlarged diameter ring of said plunger and the other end of said ring biasing against a spring retainer attached to said housing; and said spring retainer having an angled annular end coaxially disposed inside said open rim edge and adapted to contact the ball, said spring resiliently urges said marking material away from said first end of said housing absent said counter bias exerted upon said plunger.

2. The invention as defined in claim 1 wherein said marking material comprises chalk.

3. The invention as defined in claim 1 wherein said plunger is rotatably mounted to said housing.

4. The invention as defined in claim 1 wherein said housing is tubular and cylindrical in shape.

5. The invention as defined in claim 1, further comprising a cup secured to an end of said plunger projecting from said housing.

6. The invention as defined in claim 2, said chalk further comprising a cylindrical shape partially seated within said plunger.

* * * * *